United States Patent [19]

Fronske

[11] 4,166,705

[45] Sep. 4, 1979

[54] APPARATUS FOR MIXING HANDCRAFT MATERIALS

[75] Inventor: Robert D. Fronske, Tempe, Ariz.

[73] Assignee: Fronske Handcraft Equipment Corporation, Tempe, Ariz.

[21] Appl. No.: 898,182

[22] Filed: Apr. 20, 1978

[51] Int. Cl.[2] ..... B01F 9/00

[52] U.S. Cl. ..... 366/221; 366/224

[58] Field of Search ..... 366/221, 266, 219, 220, 366/222, 224, 227

[56] References Cited

U.S. PATENT DOCUMENTS

| | | | |
|---|---|---|---|
| 2,651,581 | 9/1953 | Courtney | 366/221 |
| 4,048,473 | 9/1977 | Burkhart | 366/220 |

FOREIGN PATENT DOCUMENTS

| | | | |
|---|---|---|---|
| 866055 | 4/1961 | United Kingdom | 366/221 |

*Primary Examiner*—Edward J. McCarthy

*Attorney, Agent, or Firm*—Emrich, Root, O'Keeffe & Lee

[57] ABSTRACT

A novel apparatus for mixing handcraft materials is disclosed wherein a rotatable container has positioned therein a stationary scraper bar adjacent the inner surface of said container, and an elongated rotatable mixing member substantially in the center of the container, which is rotatable therewith. The mixing member can assume different specific shapes and configurations, but as disclosed herein such member extends from the bottom of the container upwardly in substantially the form of a helix in a first direction around the central axis of rotation of the container for a predetermined distance, at which point the direction of the helix is reversed and the member continues upwardly around said axis in said reversed direction thereof until it terminates near the top of the container. The container is especially adapted to be removably mounted on a potter's wheel for rotation therewith.

14 Claims, 8 Drawing Figures

3
3
8
8

APPARATUS FOR MIXING HANDCRAFT MATERIALS

BACKGROUND OF THE INVENTION

Although the invention is particularly useful for mixing wet clay, or potter's clay, it is also well adapted for the mixing of other materials having a rather heavy consistency, such as paste, mortar, caulking compounds and the like. The consistency of the wet potter's clay for which the apparatus herein is particularly suitable is that which the clay has when it is ready to be molded, thrown or hand manipulated.

Heretofore there has not been available to the individual ceramist a small apparatus for mixing new clay or recycling the used or discarded clay and enable it to be reused. Commercial mixers for this purpose are too large and expensive for individual use. Prior to the present time it has been necessary for potters to allow the waste clay to dry and then work it or mix it together by hand.

This is a time consuming and difficult job and it has been determined that if there could be developed a mixing apparatus which could be mounted on a potter's wheel, it would be particularly advantageous. It has been only recent that there has been developed an apparatus which includes a potter's wheel which has been powered by means sufficiently powerful to enable the present invention to be used.

BRIEF SUMMARY OF THE INVENTION

The invention relates generally to an apparatus for mixing materials having a rather heavy consistency, such as wet clay or potter's clay. More especially, the invention involves the use of a container which is rotatable, and within which there is positioned a stationary blade adjacent the inner surface of the container and a rotating mixing member in the center of the container, so that when the container is rotated the material therein will be scraped from the side and bottom of the container and will be thoroughly mixed by the rotating centrally disposed mixing member.

More specifically, the blade or mixing assembly comprises three primary parts. One is a central shaft fixed within the container on which two types of blades are attached. The aforementioned scraper blade or scraper bar is rigidly attached to a stationary part of the central shaft and the mixing member is attached to a rotatable portion of the central shaft for rotation with the container.

An advantageous feature of the invention is the fact that suitable means are provided on the bottom of the container so that it may be removably mounted upon a potter's wheel. Such wheel already has associated therewith suitable mechanism for rotating it, so that when the used clay is to be recycled, it may be mixed with a suitable amount of water and any other desired ingredients and placed within the container so that rotation of the wheel will rotate the container. The material is then mixed as above mentioned, by reason of the stationary scraper bar and the central rotating mixing member.

In the light of the foregoing, it is a principle object of the present invention to provide a novel mixing apparatus for mixing such materials as wet potter's clay, either new or for reuse, wherein such apparatus may be removably mounted on a potter's wheel.

A further object of the invention is to provide a mixing apparatus for the mixing of materials having a relatively heavy consistency, such as potter's clay which is ready to be molded, thrown or hand manipulated, wherein a rotatable container has two mixing members therein, one of which is a stationary blade and the other of which is a rotatable member positioned centrally of the container and rotatable therewith.

A further and more specific object of the invention is to provide an apparatus for mixing materials having a heavy consistency wherein the mixing member centrally disposed within the container has a novel configuration wherein the lower portion thereof is in the form of a helix surrounding the central shaft of axis of the container and extends in one direction for a predetermined distance upwardly toward the top thereof, and then continues to extend upwardly in the shape of a helix but in a reverse direction.

Other objects and purposes of the invention will appear more fully as the description proceeds.

DESCRIPTION OF THE DRAWING FIGURES

DETAILED DESCRIPTION OF THE INVENTION

Figure 1:
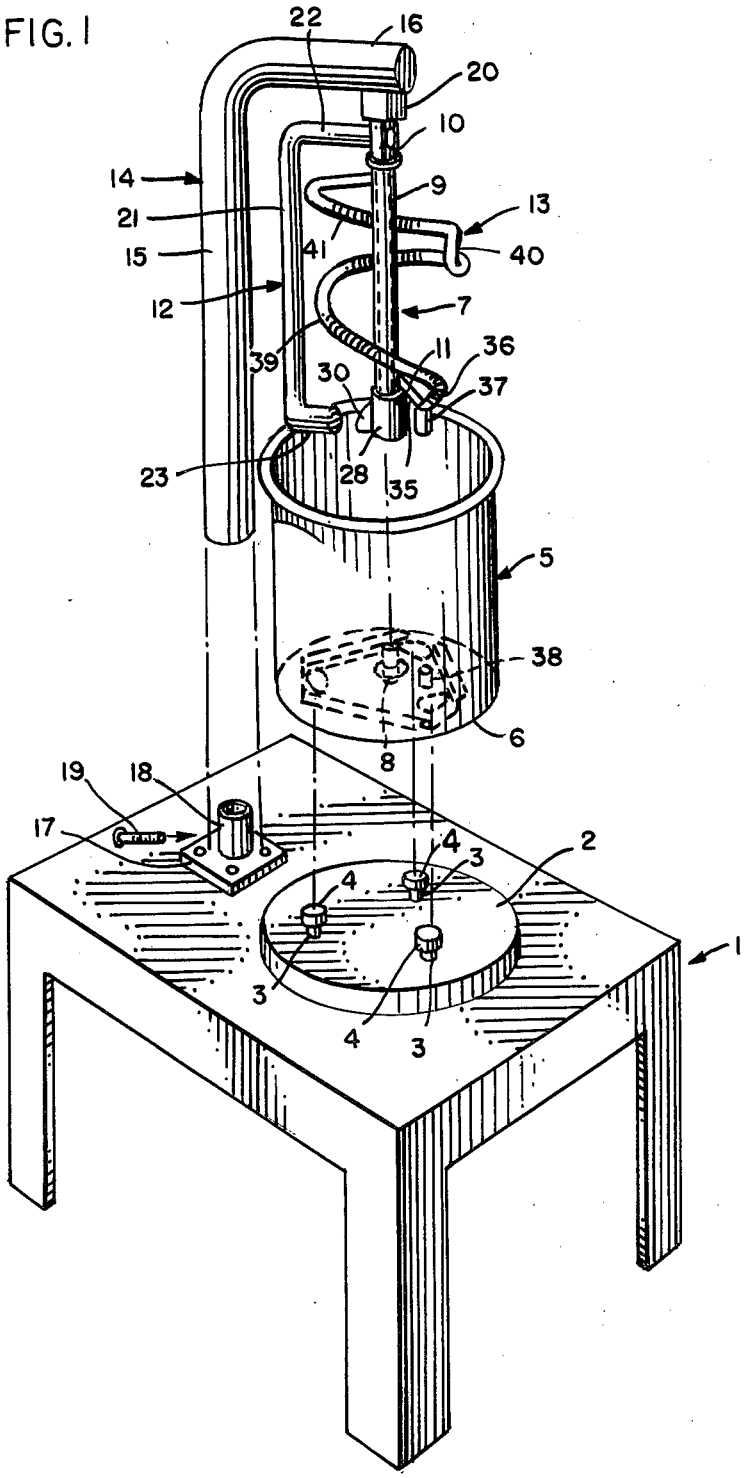
FIG. 1 is an exploded perspective view showing the relationship between the various elements of the apparatus of the present invention.

Referring now more particularly to the drawings, and especially to FIG. 1, the invention herein is illustrated as being associated with a potter's wheel which is rotatable and which may have removably mounted thereon a suitable container for the material which is to be mixed. A suitable table generally indicated by the numeral 1 has mounted thereon a potter's wheel 2 which is rotatable and which has associated therewith a suitable driving mechanism for rotating the wheel, such mechanism, however, is not shown since it does not form any part of the present invention.

The wheel 2 has a plurality of headed pins or studs 3 extending upwardly from the surface of the wheel and spaced therearound as shown. Each of the studs 3 is provided with a head 4 thereon and, as will appear more fully hereinafter, this enables the container to be removably mounted on the wheel 2.

The container in which the material to be mixed is placed is indicated generally by the numeral 5. This container is preferably circular and is provided with a bottom portion 6. A central shaft generally indicated by the numeral 7 has an opening in the bottom thereof adapted to receive a bearing member which receives the centrally disposed pin 8. As will be described more fully hereinafter, this central shaft 7 has a rotatable central portion 9, an upper stationary portion of male chuck 10, and a bottom stationary portion 11. The scraper bar is indicated generally by the numeral 12 and is secured to the stationary end or chuck 10. The mixing member which is rotatable with the container is indicated generally in FIG. 1 by the numeral 13. The detailed configuration of this member will be described in greater detail hereinafter. This member is mounted on the rotatable portion 9 of the central shaft 7.

A supporting standard for the assembly is indicated generally by the numeral 14 and includes an elongated vertically extending tubular portion 15 and a horizontal portion 16 at the top end thereof. The surface of the table 1 has mounted thereon adjacent the wheel 2 a mounting bracket comprising a base 17 and a tube 18 extending upwardly therefrom for a short distance. The bottom of the tubular member 15 is adapted to be received by the tube 18 when assembled therewith, and a set screw 19 is provided which extends through the lower end of the member 16 and through tube 18 thereby to prevent relative motion between the two members.

Adjacent the outer end of the horizontal tubular portion 16 of the supporting member 14, there is provided a downwardly extending female chuck 20 provided with a square or other suitable multi-sided opening to receive the square male chuck 10 at the upper end of the central shaft 7. This, then, prevents any rotation of the chuck 10. The scraper bar 12 has a substantially C-shaped configuration including a substantially vertically extending portion 21 having at the upper end thereof an arm 22 extending toward and welded or otherwise secured to the male chuck 10. The lower end of the scraper bar also has an inwardly extending portion 23 positioned adjacent the bottom of the container 5. As the container rotates, the central portion 21 of the scraper bar located adjacent to the inner surface of the container, will scrape the material being mixed from the inside wall of the container, while the lower inwardly extending portion 23 will scrape the material from the bottom of the container.

In general it may be said that the mixing member 13 has a configuration which tends to pick up and/or cut through the material within the container, including that which has been scraped from the bottom and sides thereof by the stationary scraper bar, and move it upwardly, thoroughly mixing it as it moves. It has been found that for best results the mixing member takes the form of a substantial helix which extends upwardly from the bottom of the container around the central shaft therein in one direction for a predetermined distance, and then the direction is reversed so that the member continues upwardly in substantially the form of a helix to the termination point thereof.

Figures 2, 3, 8:
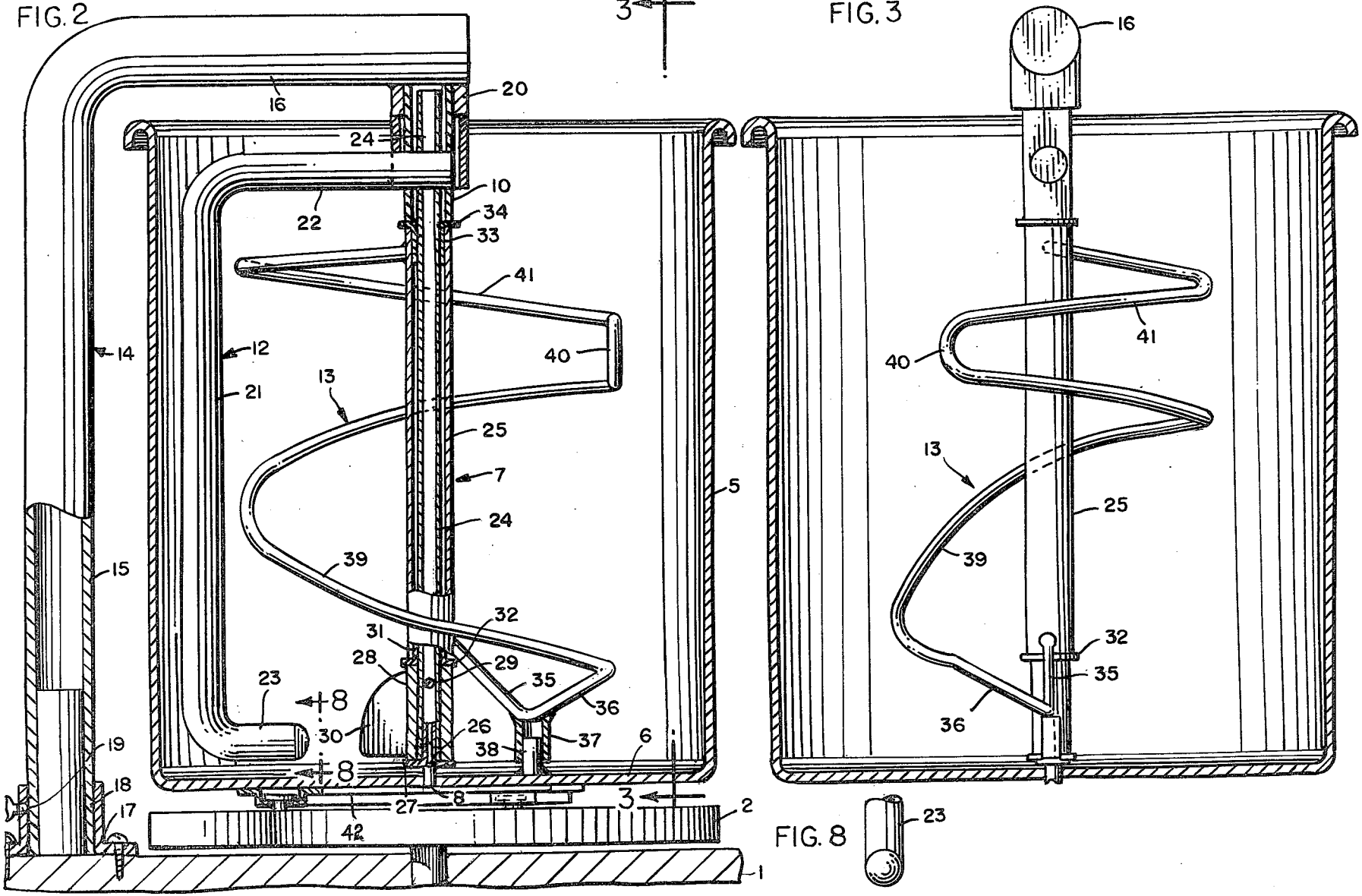
FIG. 2 is an enlarged side elevational view, partly in section, showing the various elements of the apparatus in assembled relation.
FIG. 3 is a view similar to FIG. 2 but looking toward the left thereof in the direction of the arrow 3—3.

While FIG. 1 of the drawings illustrates in general the assembly, reference may now be had particularly to FIGS. 2 and 3 for a more clear understanding of the construction, particularly of the center shaft. This shaft 7 comprises an inner tubular member 24 and an outer tubular member 25. This outer tubular member 25 is rotatable with respect to the inner tube 24. The inner tube 24 extends downwardly to a point adjacent the bottom of the container 5. The lower end of the tube 24 receives the lower bearing member comprising a tubular portion 26 and an outwardly flanged bearing portion 27 at the bottom thereof which receives the pin 8 and rests on the bottom of the container.

An outer sleeve 28 surrounds the tube 24 and is held stationary therewith and against rotation with respect to the outer tube 25 by means of a pin 29 which extends through the tubular sleeve and the inner tube 24.

This outer sleeve 28 has secured thereto and extending outwardly therefrom a scraper blade 30 which cooperates with the inwardly extending lower end 23 of the scraper bar 12. A further tubular bearing member 31 is received in the lower end of the outer tubular member 25 and has an outwardly extending annular flange 32 which rests upon the upper end of the sleeve 28. The inner tube 24 extends downwardly through this bearing member 31, so that the tubular portion of this bearing member also acts as a spacer between the inner and outer tubes 24 and 25 respectively.

A similar bearing member having a tubular portion 33 and an outwardly extending flange 34 thereon is received within the upper end of the outer tubular member 25. The inner tubular member 24 extends upwardly through this tubular portion 33 of the upper bearing member, thereby forming a spacer between the inner and outer tubes.

As may be evident from FIG. 2 of the drawing, the inner tube 24 extends all the way up through the male chuck 10 and may be welded or otherwise secured thereto. The horizontal inwardly extending upper end portion 22 of the stationary scraper bar 12 extends through the male chuck 10 as well as through an opening in the inner tube 24 and is welded to both of these members.

As indicated heretofore, the rotatable mixing member has a novel configuration which is substantially in the form of a helix. The lower portion constitutes a helix extending in one direction around the central shaft, and the upper portion thereof constitutes a helix which extends in the opposite or reverse direction around the central shaft and terminates near the upper end thereof.

The elongated mixing member has heretofore been identified by the numeral 13. It is secured to the outer rotatable tubular member 25 at suitable points thereon. As shown, since this member takes the form of a substantial helix which surrounds the central shaft in spaced relation thereto, it is secured, such as by welding or otherwise, to the outer tube at the upper and lower ends thereof.

Referring now again to FIGS. 2 and 3, it will be noted that the mixing member is an elongated rod or tube surrounding the central shaft in spaced relation thereto and extends from a point adjacent the bottom of the container to a point near the top thereof. At the lower end of this elongated mixing member, first portion 35 one end of which is secured to the outer tube 25 and which extends downwardly and outwardly away from the central shaft. The mixing member then extends upwardly for a short distance as at 36. At the juncture of these two portions 35 and 36, there is provided a downwardly extending member 37 adapted to engage the pin 38 which extends upwardly from the bottom 6 of the container 5. Thus, when the container is caused to rotate, this interconnection between the bottom of the container and the mixing member 13, will cause such mixing member to rotate with the container.

At the end of the portion 36 of the mixing member 13 the rod or tube of which it is formed continues upwardly around the central shaft in a first direction substantially in the form of a helix. This helix extends upwardly in a direction opposite to the direction of rotation of the container. For example, if the wheel or container rotates in a counter-clockwise direction, then the helix should extend upwardly in a clockwise direction. The angle at which the helix extends upwardly is critically between certain maximum and minimum limitations, depending upon the consistency of the material being mixed. The greater the angle of the helix the better will be the cutting action. The less the angle the better the smearing action.

The angle of the helix will also depend to a certain extent upon the size of the apparatus and the height of the container. Furthermore, the angular distance around the central shaft through which the rod of the mixing member extends may vary. As mentioned heretofore, as the rod of the mixing member extends upwardly for a predetermined suitable distance, its direction is reversed so that the member continues to extend upwardly also in the form of a helix and around the central shaft, but preferably at a lesser angle and for a lesser angular distance. This serves the function of retaining the mixed material within the container.

Referring again to FIGS. 2 and 3, that portion of the elongated mixing member which extends in substantially the form of a helix in a first direction is indicated by the numeral 39. As may be seen, the angular distance around the central shaft through which the member extends in this first direction is preferably approximately 360°. At that point, the rod has a reverse bend in it as may be seen at 40, whereupon the member continues upwardly in substantially the form of a helix for approximately 180° to the termination thereof at its upper end which is then bent inwardly and is secured at such upper end to the outer tubular member 25. This portion of the mixing member is indicated by the numeral 41. Again, the angular distances through which the portions of the mixing member 13 extends may be varied to suit different sizes of apparatus and different consistencies of material being mixed, but for use with wet potters clay having a consistency which is ready for molding, excellent results have been obtained when this upper part 41 of the mixing member extends around the central shaft for approximately 180° and the lower part 39 extends for approximately 360°. Furthermore it should be noted that the angle of rise of this section 41 of the reverse helix is less than the angular rise of the section 39 of the lower part of the helix since this serves the function of retaining the mixed material within the container.

From the foregoing description it will be evident that when the container 5 is rotated, the scraper bar 12 will remain stationary so that the intermediate and lower portions thereof may substantially scrape material from the sides and bottom of the container, and the blade 30 will cooperate with the lower portion 23 of the scraper bar in removing material from the bottom of the container and prevent "building up" of the material being mixed. Also, the elongated mixing member 13, being engaged with the pin 38 on the bottom of the rotating container, will rotate therewith.

Figure 4:
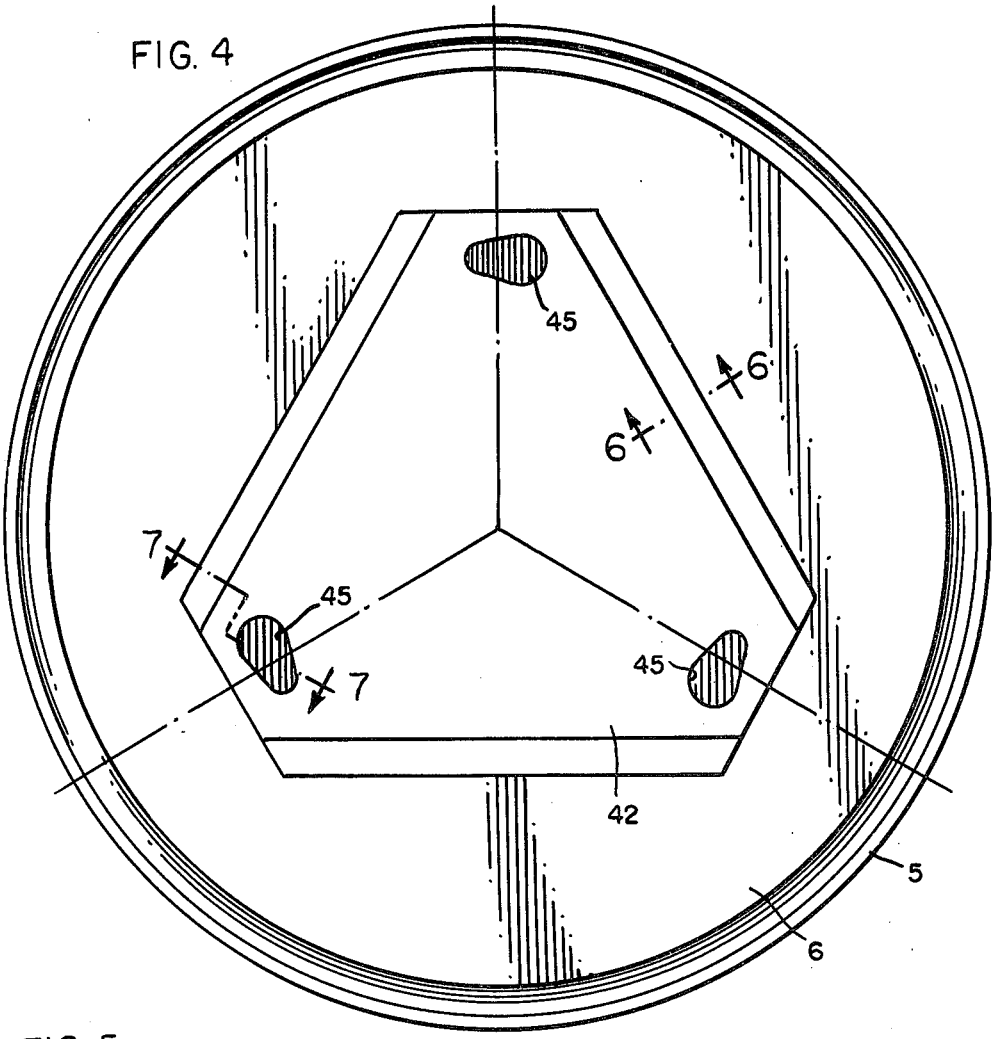
FIG. 4 is a bottom view of the container showing the means by which the container is removably mounted on the potter's wheel.
Figure 5:
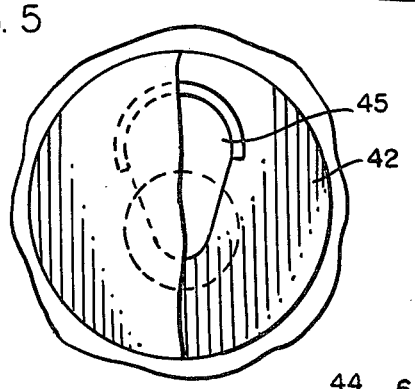
FIG. 5 is an enlarged view of one of the mounting members shown in FIG. 4 partly in elevation and partly in section.
Figure 6:
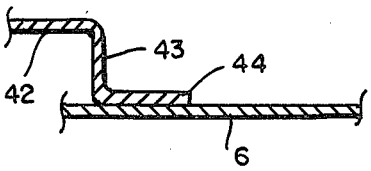
FIG. 6 is a sectional view taken substantially along the plane of line 6—6 of FIG. 4.

It will be evident that any suitable means may be utilized for removably securing the container 5 to the wheel 2. One convenient manner of doing this is to utilize headed studs extending upwardly from the wheel and elongated slots in the bottom of the container, wherein such slots are larger at one end than the other, so that the container may be placed on the wheel in such manner that the heads of the studs will be received within the larger end of each slot, and when the container is then rotated in the proper direction, the portions of the studs with lesser diameter will be received and locked in the narrower or smaller ends of the slots. A preferred form of the mounting means is illustrated in FIGS. 4 through 7. A bottom plate, of any suitable configuration is preferrably provided for attachment to the bottom 6 of the container 5. This plate in FIG. 4 is indicated by the numeral 42 and assumes a substantially triangular shape. The greater area of the plate 42 is mounted to be in spaced relation with respect to the bottom of the container. This is accomplished by providing along the sides of the triangle vertically extending leg portions 43 (see FIGS. 6 and 7) thereby providing spacer members for mounting the plate 42 in spaced relation with the bottom 6 of the container. Each leg 43 terminates in an outwardly extending flange portion 44 welded or otherwise secured to the bottom of the container so that the plate 42 will be positioned in spaced relation thereto.

There are a plurality of openings provided in the plate adapted to receive the studs which extend upwardly from the wheel 2. As illustrated, there are three such openings one at each corner of the triangular plate 42. These openings are identified by the numeral 45 and take the form of elongated slots each of which is larger at one end than the other. These may take specifically the form of a teardrop as shown, or any other suitable form such as a keyhole slot.

Figure 7:
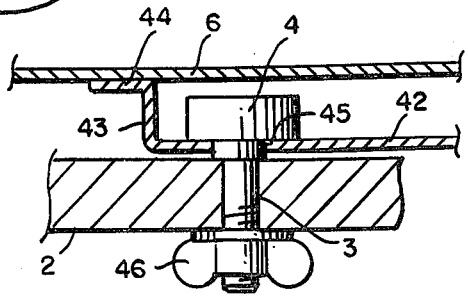
FIG. 7 is a sectional view taken substantially along the plane of line 7—7 of FIG. 4.

FIG. 7 is a transverse sectional view through the bottom of the container and the plate 42 as well as one of the slots 45, and the wheel 2. This illustrates the studs 3 which extend upwardly through the wheel 2 and extend above the surface thereof to be received within the openings 45. The large end of each opening is sufficiently wide to receive the head 4 of each of the studs so that, after the container is in place and shifted or rotated slightly, the body of each stud will be snugly received within the smaller end of each of the openings 45. Preferably the lower portion of each stud 3 is threaded so that a nut, such as the wing nut 46, may if necessary, be used to tighten and secure the container in place on the wheel, or the shoulder should be, and preferably is, of such dimension as to allow a snug fit merely by twist locking the container in place.

From the foregoing description it will be evident that, the container 5 may first be placed upon the wheel and rotated to a locked position thereon. The supporting standard 14, with the scraper bar 12, central shaft 7, and the elongated helical mixing member 13, all mounted thereon, may then be placed over the stud 18 on the table 1 and secured thereto against rotation. This will then position the various parts as illustrated in FIGS. 2 and 3.

The clay, or other material to be mixed, is then placed within the container 5 and the container is caused to rotate. As the rotation takes place the action of the scraper bar 12 and the rotating elongated mixing member will thoroughly mix the material within the container for subsequent use.

Thus, while I have illustrated and described the preferred embodiment of my invention, it is to be understood that this is capable of variation and modification, and I therefore do not wish to be limited to the precise details set forth, but desire to avail myself of such changes and alterations as fall within the purview of the following claims.

I claim:

1. Apparatus for mixing handcraft materials, such as potter's clay, comprising:

(a) a container for the material to be mixed,
(b) means for rotating said container,
(c) a stationary scraper bar positioned within said container adjacent the inner surface thereof and extending generally in a direction substantially parallel with the axis of rotation of said container for scraping from said inner surface the material being mixed,
(d) means for supporting said scraper bar within said container, and
(e) an elongated mixing member mounted within said container and rotatable therewith,
(f) said mixing member extending
(1) from a point adjacent the bottom of said container is substantially the form of a helix in a first direction around the axis of rotation thereof for a predetermined distance toward the top of said container, and then
(2) in a reverse direction substantially in the form of a helix around said axis and toward the top of said container for the remainder of the length thereof.

2. The combination of elements defined in claim 1, wherein said means in (b) include a rotatably mounted potter's wheel, and means for mounting said container on said wheel.

3. The combination of elements defined in claim 1, wherein said means in (b) include a rotatably mounted potter's wheel, a plurality of headed studs on the face of said wheel, and mounting means on the bottom of said container provided with a like plurality of slots therein, each of which is smaller at one end than the other, and each adapted to receive one of said studs in the larger end thereof and to be manually rotated to position said stud in the smaller end thereof, thereby to lock said container to said wheel for rotation therewith.

4. The combination of elements defined in claim 1, wherein said stationary scraper bar includes a substantially straight vertical portion, and a terminal portion at the lower end thereof extending inwardly toward the axis of rotation of said container from the lower end of said vertical portion and adjacent the bottom of said container.

5. The combination of elements defined in claim 1, combined with a vertically disposed central shaft extending from the bottom of said container upwardly toward the top thereof, at least a portion of said shaft being rotatable, means mounting said elongated mixing member on said rotatable portion of said shaft, and means for removably connecting said member to the bottom of said container, whereby said container and said member will rotate together.

6. The combination of elements defined in claim 1, wherein said first direction of the helix extends around said axis of rotation thereof for substantially 360°.

7. The combination of elements defined in claim 1, wherein said reverse direction of the helix extends around said axis of rotation for substantially 180°.

8. The combination of elements defined in claim 1, wherein the angle of rise of said first named helix in the first direction thereof toward the top of said container is greater than the angle of rise of the helix extending in said reverse direction.

9. The combination of elements defined in claim 5 wherein said last named means includes a pin extending upwardly from the bottom of said container, and a complementary member extending downwardly from said mixing member adapted to engage said pin.

10. Apparatus for mixing handcraft materials, such as potter's clay, comprising:
(a) a container for the material to be mixed,
(b) a potter's wheel,
(c) interengaging means on the bottom of said container and on the upper surface of said wheel, thereby to mount said container on said wheel for rotation therewith,
(d) an elongated helical mixing member mounted within said container and rotatable therewith,
(e) means positioned within said container for supporting said mixing member in spaced relation to the inner surface of said container,
(f) a stationary scraper bar mounted within said container having a first portion adapted to scrape material being mixed from the inner surface of said container, and a second portion adapted to scrape material being mixed from the bottom of said container, and
(g) means for rotating said wheel and container.

11. A mixing member adapted for use with apparatus for mixing handcraft material, such as potter's clay, which apparatus includes a container for said material, said mixing member comprising:
(a) an elongated supporting element, and
(b) an elongated rod or tube surrounding said supporting element in spaced relation thereto, said rod or tube being
(1) secured to said element at a point adjacent one end thereof and extending in substantially the form of a helix in a first direction around said element for a predetermined distance toward the other end thereof, and then
(2) extending in a reverse direction around said element toward said other end thereof for the remainder of its length and secured to said element adjacent said other end.

12. The combination of elements defined in claim 11, wherein the distance around said element through which said first direction of the helix extends in substantially 360°.

13. The combination of elements defined in claim 11, wherein the distance through which said rod or tube extends around said element in said reverse direction is substantially 180°.

14. The combination of elements defined in claim 11, wherein the angle of rise of said rod or tube around said element in said first direction, when said element is in a vertical position, is greater than the angle of rise of said rod or tube around said element in said reverse direction.

* * * * *